US005365316A

United States Patent [19]

Motoyama et al.

[11] Patent Number: 5,365,316

[45] Date of Patent: Nov. 15, 1994

[54] ELECTROPHOTOGRAPHIC IMAGE FORMING APPARATUS AND ITS HIGH VOLTAGE POWER SOURCE DEVICE

[75] Inventors: Hajime Motoyama, Kawasaki; Junichi Kimizuka, Yokohama; Takeji Gima, Toride; Akihiro Nakamura, Kawasaki, all of Japan

[73] Assignee: Canon Kabushiki Kaisha, Tokyo, Japan

[21] Appl. No.: 107,593

[22] Filed: Aug. 18, 1993

[30] Foreign Application Priority Data

Aug. 20, 1992 [JP] Japan ..... 4-221172
Oct. 29, 1992 [JP] Japan ..... 4-291198

[51] Int. Cl.[5] ..... G03G 15/00; G03G 15/02; G03G 15/08

[52] U.S. Cl. ..... 355/219; 355/246; 363/25

[58] Field of Search ..... 355/200, 204, 214, 219, 355/246; 363/24, 25, 133, 134; 323/267

[56] References Cited

U.S. PATENT DOCUMENTS 4,292,387 9/1981 Kanbe et al. ..... 430/102
4,851,960 7/1989 Nakamura et al. ..... 361/255
5,111,235 5/1992 Ueno et al. ..... 355/246
5,198,860 3/1993 Yamanaka et al. ..... 355/246
5,229,818 7/1993 Nakabara et al. ..... 355/219 X

FOREIGN PATENT DOCUMENTS 4-066973 3/1992 Japan .

*Primary Examiner*—Joan H. Pendegrass
*Attorney, Agent, or Firm*—Fitzpatrick, Cella, Harper & Scinto

[57] ABSTRACT

An image forming apparatus includes: a photosensitive drum; a charging unit which is brought into contact with the drum and charges it; a developing unit for obtaining a visible image from an electrostatic latent image formed on the drum; a charge high voltage generation circuit for supplying an output which is obtained by multiplexing a high AC voltage with a high DC voltage with the charging unit; a development high voltage generation circuit for supplying an output which is obtained by multiplexing a high AC voltage with a high DC voltage to the developing unit; and a sync circuit for synchronizing a high voltage alternating current of the charge high voltage generation circuit and a high voltage alternating current of the development high voltage generation circuit. A ratio of the frequencies of the high voltage alternating currents of the development high voltage generation circuit and the charge high voltage generation circuit is set to an integer. The high AC voltages are derived from the signals having an integer frequency dividing ratio which are obtained by frequency dividing the same clock signal.

10 Claims, 10 Drawing Sheets

ELECTROPHOTOGRAPHIC IMAGE FORMING APPARATUS AND ITS HIGH VOLTAGE POWER SOURCE DEVICE

BACKGROUND OF THE INVENTION

1. Field of the Invention

The present invention relates to an image forming apparatus of the electrophotographic type and its high voltage power source device.

2. Related Background Art

Hitherto, an image forming apparatus of the electrophotographic type (copying apparatus, printer, or the like) is constructed as shown in, for example, FIG. 5. In the diagram, reference numeral 1 denotes a controller to control an electrophotographic processing sequence and has a CPU; 2 indicates a high voltage power source device; 3 indicates a drum as a photosensitive member; 4 indicates a roller as a charging member; 5 indicates a scanner to scan using a laser beam; 6 indicates a reflecting mirror of the laser beam; 7 indicates a developing unit having a toner carrier; 8 indicates a transfer charging unit; and 9 indicates a cleaner.

In the charging of such an image forming apparatus, in the case where the charging member 4 is directly come into contact with the photosensitive member 3 and the photosensitive member 3 is charged as shown in the diagram, an output which is obtained by directly multiplexing an AC bias to a DC bias is used as a high voltage output that is applied to the charging member 4. One of the above charging means has already been proposed by the same applicant as that of the present invention as shown in U.S. Pat. No. 4,851,960. In this instance, since a potential of the DC bias is set to the surface potential of the photosensitive member 3, the DC bias is subjected to a constant voltage control. The voltage at this time is equal to a voltage according to a concentration within a range of about −750 V to −600 V. The AC bias is used to efficiently charge the drum. Although a proper AC voltage is needed for charging, in the case where the AC voltage is too high, there is a drawback in that an electric breakdown of the photosensitive member 3 may occur. It is, accordingly, necessary to control the voltage to a proper voltage value. Although the optimum condition of the AC voltage which is applied to the charging member 4 varies depending on the environment, a voltage within a range of about 1600 $V_{pp}$ (peak to peak) to 2000 $V_{pp}$ is optimum. A frequency of the AC bias is set to a frequency within a range of about 100 Hz to a few kHz. Such a frequency is substantially determined by a processing speed of the electrophotographic apparatus. However, since a sound of a frequency that is twice as high as the AC frequency is generated by the charging member 4 and the frequency of such a generated sound lies within an audible range (that is, it is accompanied by noise), it is therefore, necessary to set the frequency as low as possible. On the other hand, even when the frequency is too high, a good charging state cannot be obtained. To suppress the noises as much as possible, an ordinary sine wave is used for the purpose of reduction in harmonics. An output which is obtained by multiplexing the AC bias to the DC bias is used as a high voltage output which is applied to the developing unit 7 for obtaining a visible image from an electrostatic latent image on the photosensitive member 3 by using a developing agent as shown in a developing method disclosed in U.S. Pat. No. 4,292,387. In this instance, an output voltage of the AC bias within a range of about 1200 $V_{pp}$ to 1700 $V_{pp}$ is used. A frequency is set to about a few kHz.

In the above conventional example, however, there is a drawback in that an AC voltage which is used for charging interferes with an AC voltage which is used for development and an interference fringe corresponding to waviness of both of the frequencies is formed in the image, so that such an interference fringe typically appears on the image formed depending on the set state of the frequency. On the other hand, the surface potential which is charged onto the photosensitive member is influenced by the AC bias and even when the DC bias generates a predetermined voltage, a slight potential difference is caused on the surface potential. Therefore, a fringe of the potential difference which is influenced by the frequency of the AC bias is produced on the photosensitive material. In a printer of the electrophotographic type, since the photosensitive member is exposed by dots of a light source, waves between the dots which are influenced by a print density of the light source for exposure are produced on the photosensitive member due to a predetermined frequency. In this instance, in the case where a frequency of the waves of the image which are produced on the photosensitive member by a combination of the print density of the light source and the image which is produced is close to the frequency of the high voltage AC bias for charging, a phenomenon such as a moire occurs on the image produced. FIG. 6 shows the above relation. FIG. 6 shows an AC frequency for charging at which a moire occurs to the print density. To avoid such a moire, the AC bias must be driven at a frequency according to the print density. In the case of efficient charging, it is necessary to set the frequency of the AC bias to a frequency within a range of about 100 Hz to 1 kHz, and it is also necessary to use a sine wave in order to reduce the harmonics at the audible frequencies because of the relation of the noise frequencies. A frequency at which the moire is prevented differs in dependence on each print density and the charging operation must be efficiently executed. It is, therefore, difficult to switch the print density in the same apparatus.

One means for solving the above problems has already been proposed by the same applicant as that of the present invention by Japanese Patent Application Laid-Open No. 4-66973. In this case, however, the frequency is set to a value which is out of integer-time relation in order to prevent an interference. It is, therefore, necessary to adjust the frequency so as not to set the frequency to a value that is an integer times as high as another frequency for each apparatus. Further, it is necessary to set the frequency so as to avoid such an integer-time relation. There is a case where the optimum combination cannot be obtained due to the frequency relation between two high voltages. Particularly, in the case where it is necessary to have a frequency dividing ratio of an odd-number of times, a duty of the output signal is not equal to 50%. Such a situation becomes a factor to generate an unnecessary DC component in the output voltage and there is a case where the picture quality is unexpectedly deteriorated.

SUMMARY OF THE INVENTION

It is an object of the invention to provide an image forming apparatus and its high voltage power source device which can solve the problems mentioned above.

According to an aspect of the invention, it is an object of the invention to provide an image forming apparatus without a fringe on the image due to an interference of a frequency of an AC bias for charging and a frequency of an AC bias for development.

According to another aspect of the invention, it is another object of the invention to provide an image forming apparatus without causing a moire on an image due to an interference of a frequency of waves on an image regarding a print density and a frequency of an AC bias for charging.

According to still another aspect of the invention, it is an object of the invention to provide an image forming apparatus of the electrophotographic type of a high performance, in which when a print density is switched, a charging AC frequency is controlled and an adverse influence on an image is eliminated, thereby preventing a moire and obtaining a clear output image and suppressing the generation of noises, and also to provide a high voltage power source device which is suitable for such an image forming apparatus.

Further, another object of the invention is to accomplish the above objects by a construction comprising: a charge high voltage generation circuit for supplying an output which is obtained by multiplexing a high voltage AC voltage to a high voltage DC voltage to a charging member which is brought into contact with a photosensitive member of an image forming apparatus of the electrophotographic type, thereby charging the photosensitive member; a development high voltage generation circuit for supplying the voltage which is obtained by multiplexing the high voltage AC voltage to the high voltage DC voltage to a developing member for obtaining a visible image from an electrostatic latent image formed on the photosensitive member; and a sync circuit for synchronizing a high voltage alternating current of the charge high voltage generation circuit with a high voltage alternating current of the development high voltage generation circuit.

With the above construction, a frequency of the development bias is set to a value which is integer times as high as a frequency of the charging bias and those two frequencies are synchronized, thereby making it possible to eliminate the occurrence of a moire due to the interference between the mutual frequencies and the generation of charging noises. Even by deciding the frequency of the AC bias for charging on the basis of the selected print density, the generation of the moire and noises can be also eliminated in a manner similar to the above.

Further, another object of the invention is to provide an image forming apparatus of the electrophotographic type comprising: a charging member which is brought into contact with a photosensitive member, thereby charging it; a first high voltage power source for supplying an output which is obtained by multiplexing a high voltage AC voltage to a high voltage DC voltage to the charging member; a developing member for obtaining a visible image from an electrostatic latent image formed on the photosensitive material; and a second high voltage power source for supplying an output which is obtained by multiplexing the high voltage AC voltage to the high voltage DC voltage to the developing member, wherein the high voltage AC voltage of the first high voltage power source and the high voltage AC voltage of the second high voltage power source are respectively formed from signals which are derived by frequency dividing the same clock signal and in which a frequency ratio after completion of the frequency division is set to an integer.

With the above construction, the high voltage AC voltage of the first high voltage power source and the high voltage AC voltage of the second high voltage power source have synchronized waveforms in which the frequency ratio is equal to an integer-time value.

Further, another object of the invention is to provide an image forming apparatus in which, by switching the frequency dividing ratio of the frequency divider in accordance with the switching of the print density of the apparatus, the generation of a fringe or moire can be prevented in spite of the fact that the print density was changed, and also to provide a power source for such an image forming apparatus.

The above and other objects and features of the present invention will become apparent from the following detailed description and the appended claims with reference to the accompanying drawings.

DETAILED DESCRIPTION OF THE PREFERRED EMBODIMENTS

An image forming apparatus and its high voltage power source device according to the present invention will now be described hereinbelow.

Figure 1:
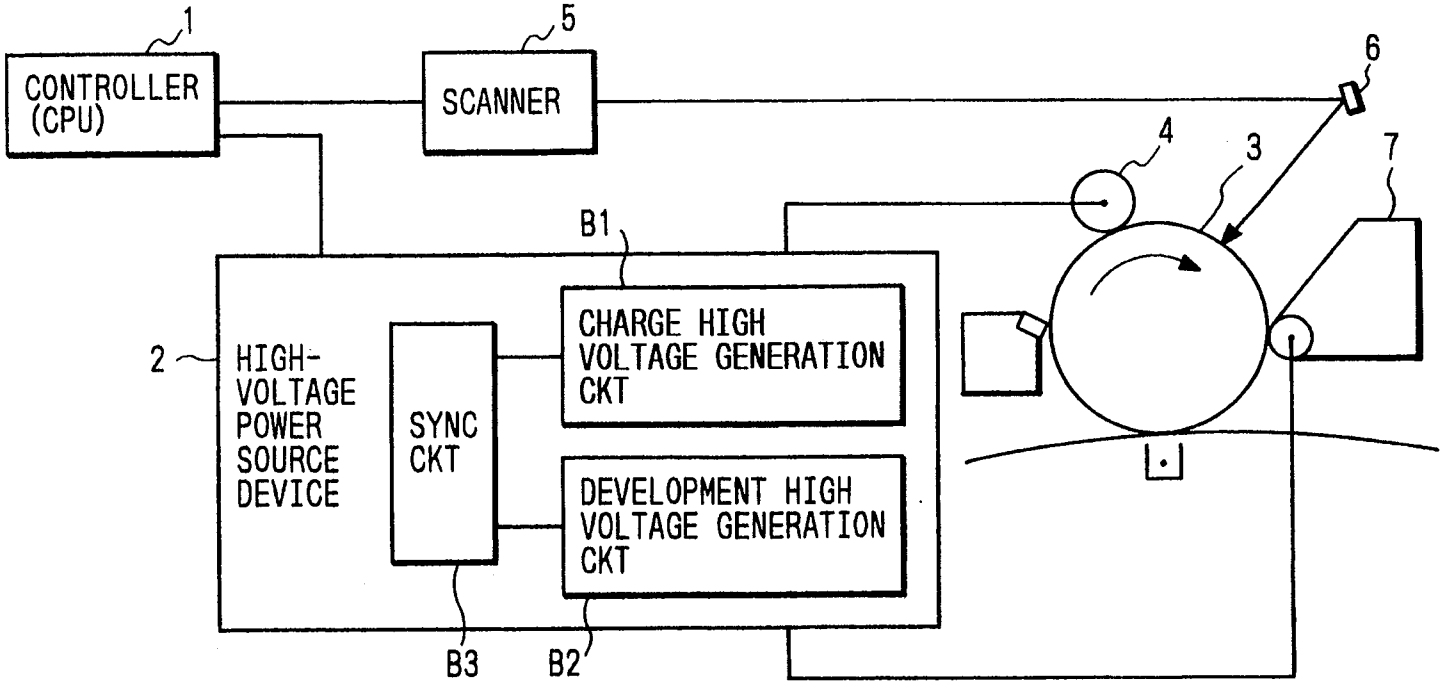
FIG. 1 is a block diagram of a main section of an image forming apparatus according to a first embodiment of the present invention.

FIG. 1 is a block diagram showing an outline of a main section of the image forming apparatus having a high voltage power source device according to a first embodiment.

Reference numeral 1 denotes the controller, and 2 indicates the high voltage power source device of the first embodiment for generating various kinds of high voltages and applying those output voltages to the charging unit 4 and the developing unit 7. Reference numeral 5 denotes a scanner for forming an image on a photosensitive member 3 through a reflecting mirror 6.

The high voltage power source device 2 and the scanner 5 are sequence controlled by the controller 1.

As shown in FIG. 1, the high voltage power source device 2 of the present embodiment comprises: a charge high voltage generation circuit $B_1$ for supplying an output voltage which is obtained by multiplexing a high AC voltage and a high DC voltage to the charging unit 4 which is brought into contact with the photosensitive member 3 of an image forming apparatus of the electrophotographic type, thereby charging it; a development high voltage generation circuit $B_2$ for supplying an output voltage which is obtained by multiplexing a high AC voltage and a high DC voltage to the developing unit 7 for obtaining a visible image from an electrostatic latent image formed on the photosensitive member 3; and a sync circuit $B_3$ for synchronizing a high voltage alternating current from the charge high voltage generation circuit $B_1$ with a high voltage alternating current from the development high voltage generation circuit $B_2$.

Figure 2:
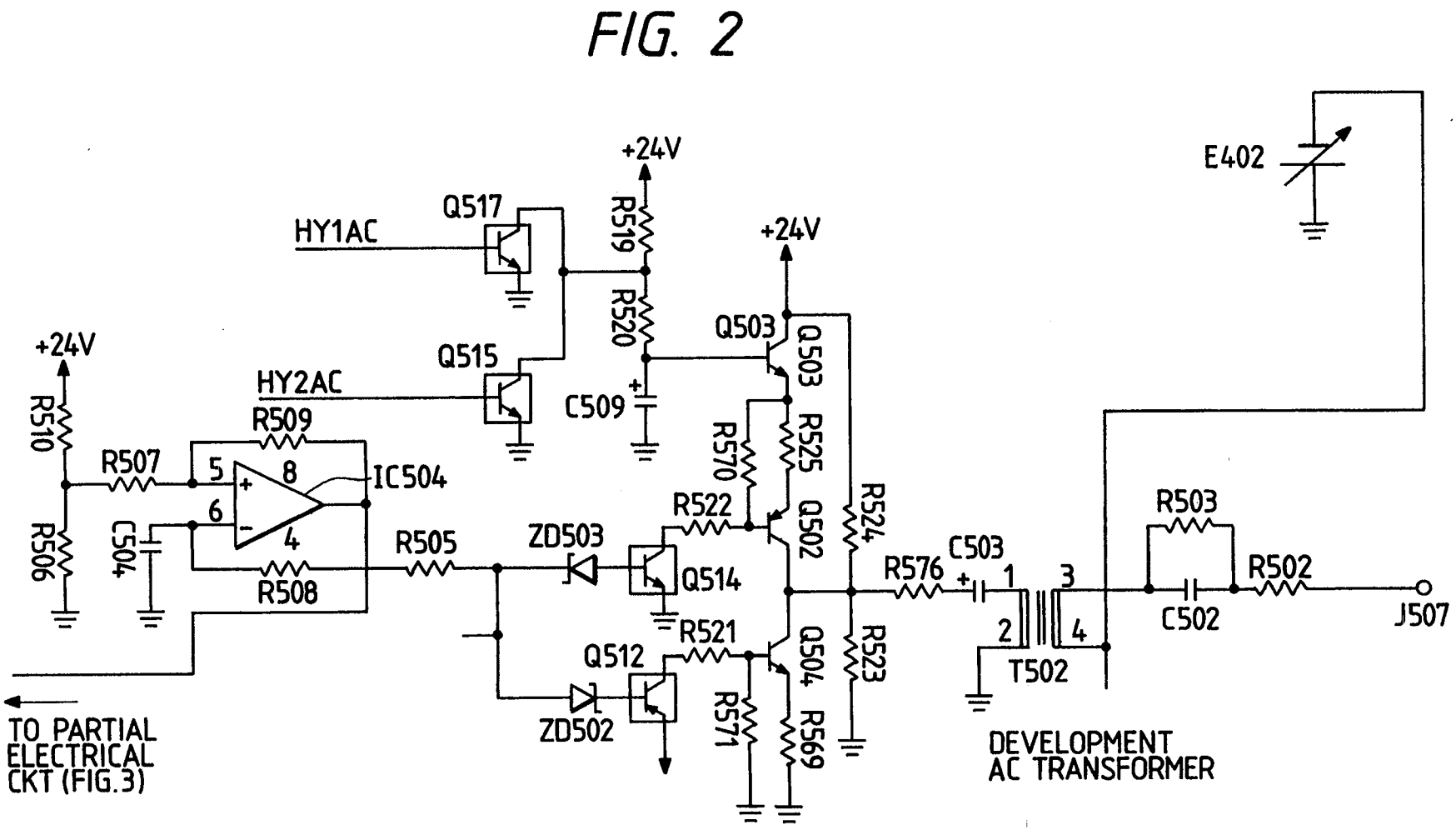
FIG. 2 is a circuit diagram of a portion of a development high voltage generation circuit of the first embodiment.
Figure 3:
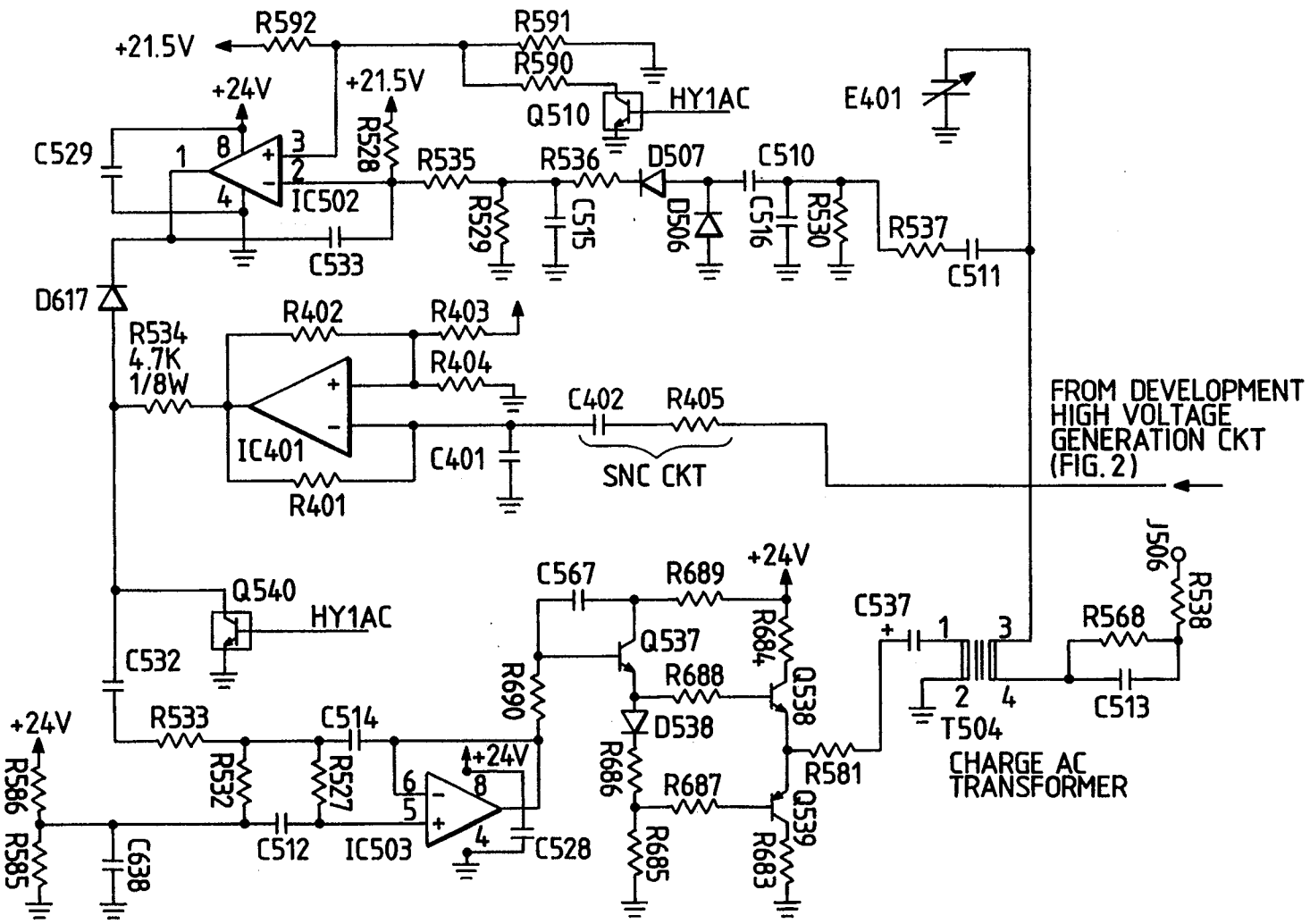
FIG. 3 is a circuit diagram of portions of a charge high voltage generation circuit and a sync circuit in the first embodiment.

FIG. 2 is a partial circuit diagram showing a portion of the development high voltage generation circuit for supplying the output voltage to the developing member. FIG. 3 is a partial circuit diagram showing the portion of the charge high voltage generation circuit for supplying an output voltage to the charging member, the sync circuit, and the like. A circuit construction and operation of the first embodiment will now be described hereinbelow with reference to FIGS. 2 and 3.

In FIG. 2 showing a construction of the development high voltage generation circuit $B_2$, T502 denotes a transformer for producing an AC bias for development. An operational amplifier IC504, resistors R506 to R510, and a capacitor C504 construct a first rectangular wave oscillator to generate a developing frequency. Transistors Q502 to Q504, Q512, and Q514, Zener diodes ZD502 and ZD503, and resistors R521 to R525, R570, R571, and R569 construct a driver of the transformer T502.

In FIG. 3 showing the charge high voltage generation circuit $B_1$, sync circuit $B_3$, and the like, T504 denotes a transformer for generating an AC bias for charging. An operational amplifier IC401, resistors R401 to R404, and a capacitor C401 construct a second rectangular wave oscillator for generating a charging frequency. An operational amplifier IC503, resistors R527, R532, and R533, and capacitors C512, C514, and C532 construct a filter. Transistors Q537 to Q539, resistors R684 to R689, and a diode D538 construct a driver of the transformer T504.

A capacitor C402 and a resistor R405 construct the sync circuit $B_3$ for synchronizing the first rectangular wave oscillator with the second rectangular wave oscillator.

R530 denotes an AC current detecting resistor for detecting an alternating current flowing in a load through a capacitor C511 and a resistor R537. A capacitor C516 is provided to eliminate the noises of high frequencies. Capacitors C515 and C510, diodes D506 and D507, and resistors R536, R529, and R535 construct a rectifying circuit for voltage doubler rectifying a voltage which is generated in the detecting resistor R530, thereby converting the voltage to a DC bias.

An operational amplifier IC502 compares the potential which is divided by resistors R590 to R592 and an output of the above rectifying circuit and controls amplitudes of the rectangular wave outputs of the oscillators through a diode D617, thereby enabling the alternating current flowing in the load to be constant current controlled.

E401 denotes a power source for generating a DC bias for charging. E402 indicates a power source for producing a DC bias for development.

The operation of the circuit in the embodiment will now be described with reference to a waveform timing chart shown in FIG. 4.

Figure 4:
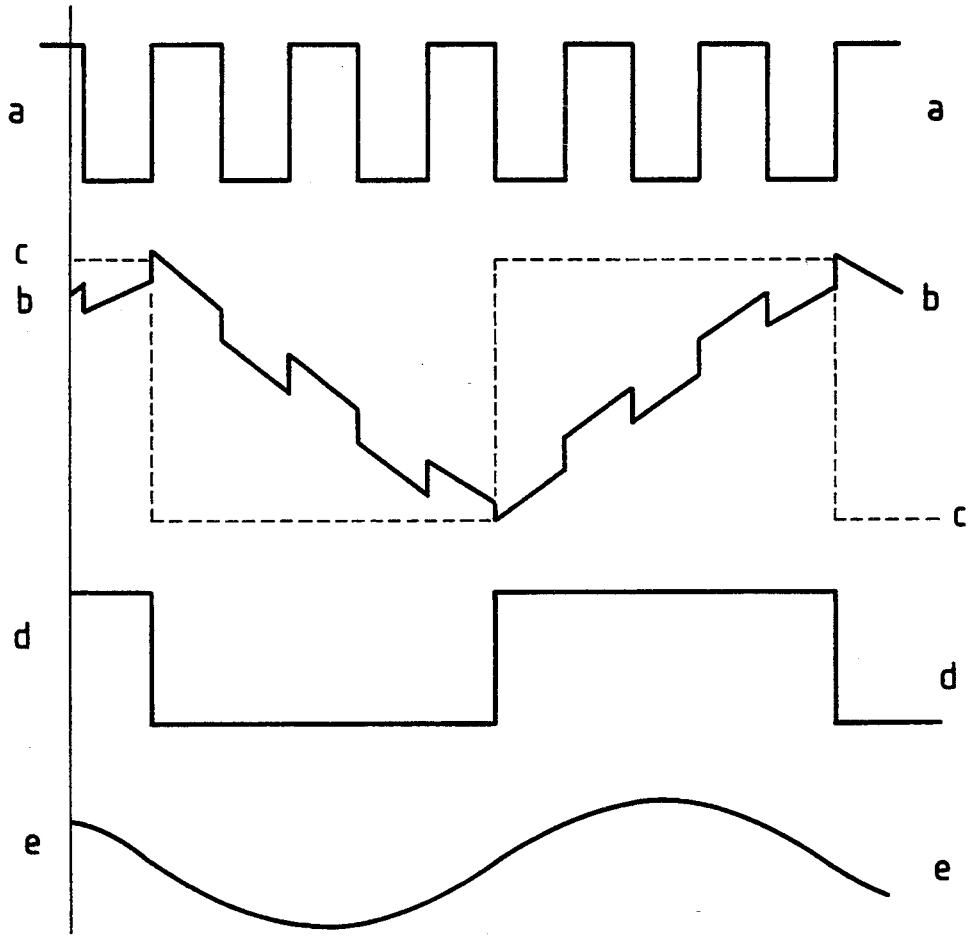
FIG. 4 is a timing chart of waveforms in the first embodiment.
Figure 5:
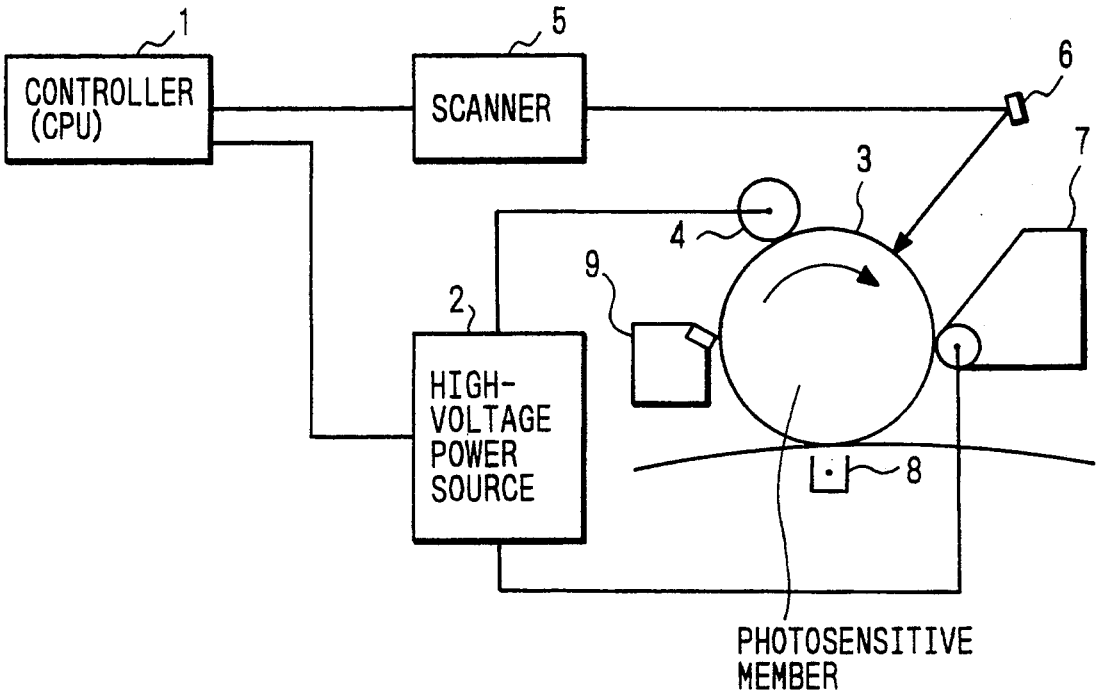
FIG. 5 is a constructional diagram of an image forming apparatus of an electrophotographic type.

In FIG. 4, a denotes an output of the first rectangular wave oscillator, namely, an output of the operational amplifier IC504. The transformer T502 of the development high voltage generation circuit is driven by the output a and generates a development high voltage to the developing unit 7. A frequency at this time is ordinarily set to a few as 2 kHz.

b shows a waveform of a negative (−) input terminal of the operational amplifier IC401 constructing the second rectangular wave oscillator. c denotes a waveform of a positive (+) input terminal of the operational amplifier IC401. In the case of efficiently charging, since a frequency within a range of about 100 Hz to 1 kHz is generally used, a frequency of the second rectangular wave oscillator must be also set to such a value. Therefore, it is set to 400 Hz.

However, the frequencies of the first and second rectangular wave oscillators fluctuate due to a variation in parts, a change in environment, or the like. In such a case, since the output of the first rectangular wave oscillator (output of the operational amplifier IC504) is connected to the negative (−) input terminal of the operational amplifier IC401 through the capacitor C402 and resistor R405, a ripple component due to the frequency of the first rectangular wave oscillator is multiplexed with the time constant waveform to determine the frequency of the second rectangular wave oscillator. Since the output of the operational amplifier IC401 is inverted by the ripple component, the output of the second rectangular wave oscillator, shown as d in FIG. 4, is synchronized with the output a of the first rectangular wave oscillator. On the other hand, the output of the second rectangular wave oscillator has a sine wave, as shown by e in FIG. 4 due to the filter constructed by the operational amplifier IC503 and the like. The transformer T504 of the charge voltage generation circuit is driven by such a sine wave output and generates a charge voltage to the charging unit.

Even when the frequencies of the first and second rectangular wave oscillators fluctuate due to variation in the parts thereof, changes in the environment, or the like, since those frequencies are synchronized as mentioned above, an adverse influence such as generation of a moire or the like on the image can be prevented.

(EMBODIMENT 2)

Figure 6:
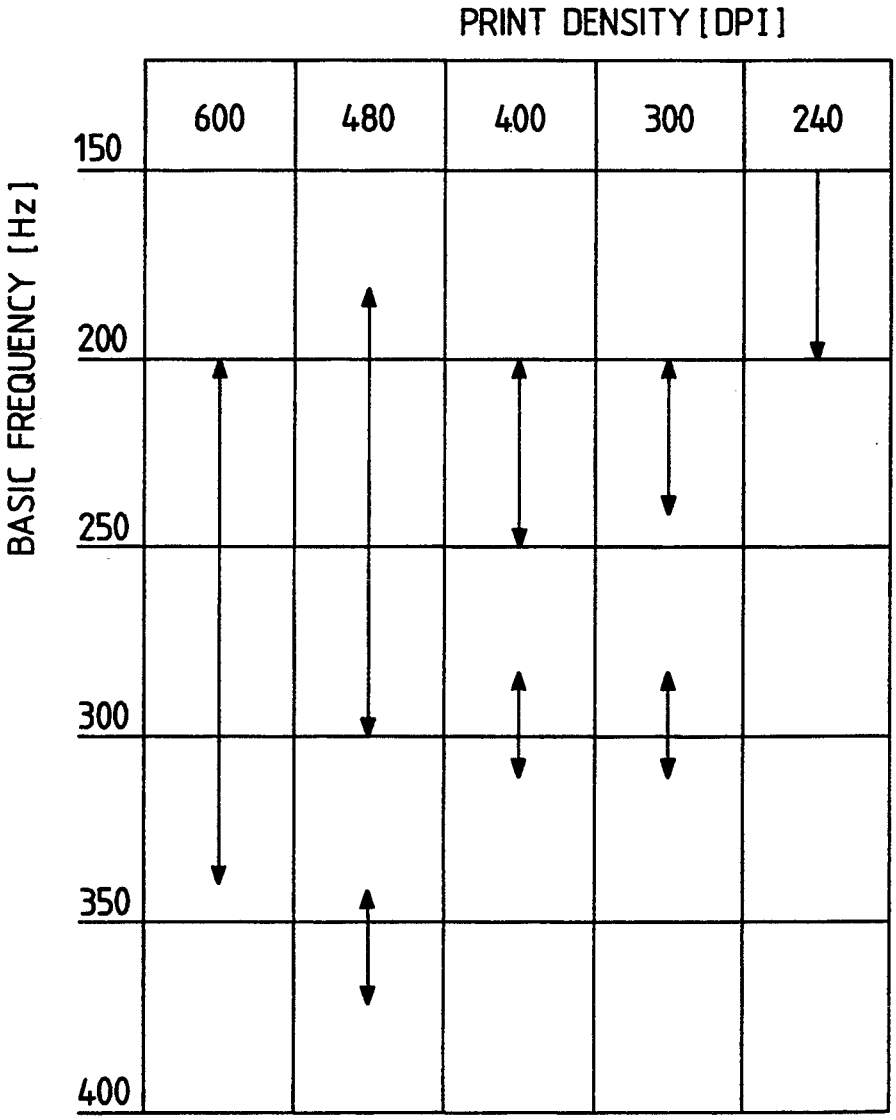
FIG. 6 is an explanatory diagram showing the relation between the print density and the AC frequency for charging at which a moire occurs.

FIG. 6 is an explanatory diagram showing the relation between the print density and the charge AC frequency at which a moire occurs as mentioned above. According to the diagram, in the case of switching the print density in the image forming apparatus, by setting the charge AC frequency to about 400 Hz, the moire can be prevented. It is, however, necessary to suppress the frequency as low as possible in order to reduce the charge noises which are generated from the charging unit. Explanation will now be made with respect to the second embodiment according to the invention in which by switching the frequency of the AC bias for charging in accordance with the selected print density, the frequency is set to a low value and the generation of charging noises can be suppressed and the occurrence of a moire also can be suppressed.

A main section of the image forming apparatus having the high voltage power source device of the second embodiment according to the invention has a construction similar to that in the case of the first embodiment, which has already been described with reference to the block diagram of FIG. 1. It is now assumed that the circuit $B_3$ shown in the block of the high voltage power source device 2 in FIG. 1 is referred to a frequency switching circuit for synchronizing and dividing the frequency. When the controller 1 generates a signal to switch the print density, it also supplies the switching signal to the high voltage power source device 2 and scanner 5.

Since a development high voltage generation circuit portion in the second embodiment has a construction similar to that in the first embodiment described with reference to FIG. 2, FIG. 2 is referred and its overlapped description is omitted.

Figure 7:
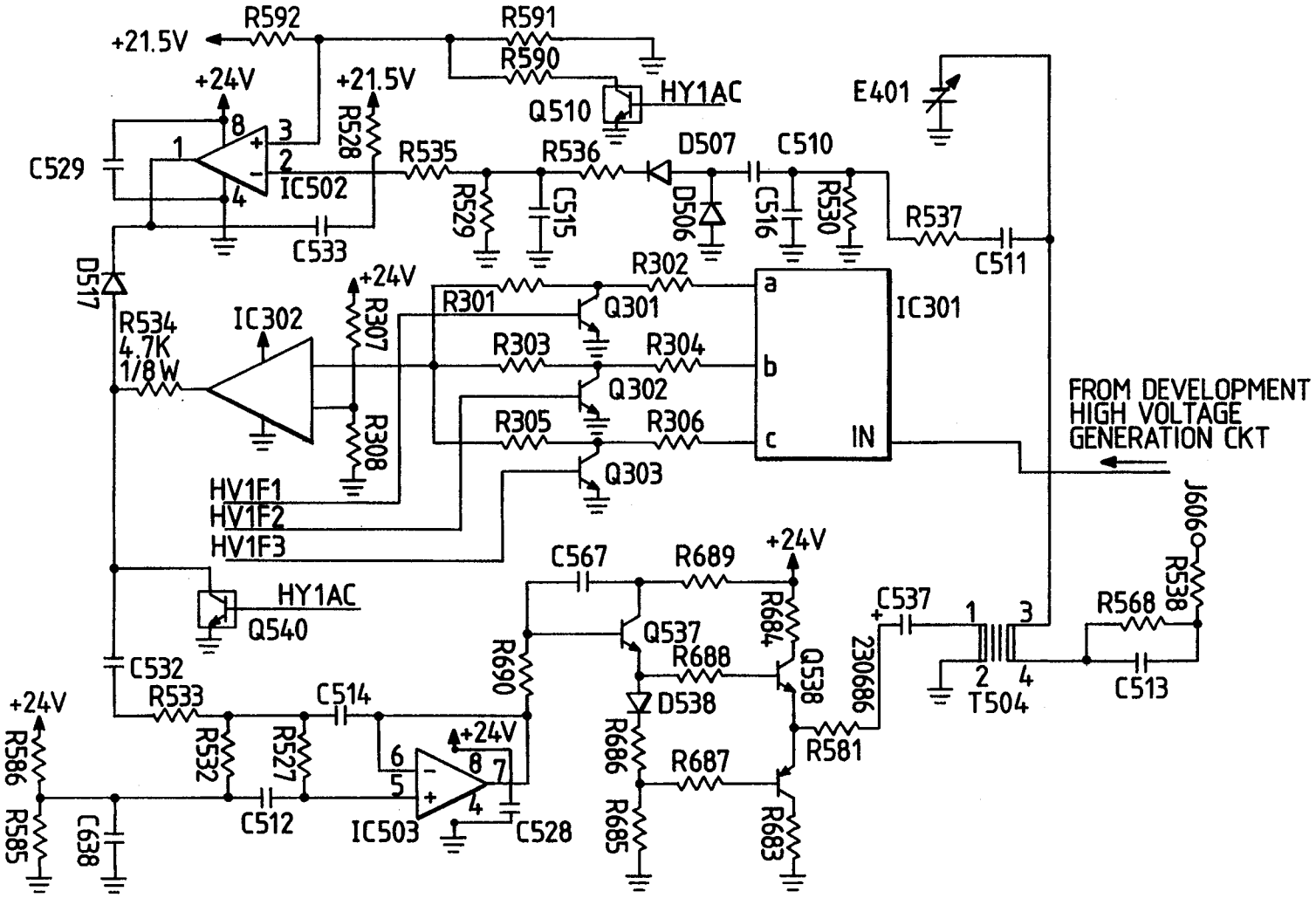
FIG. 7 is a circuit diagram of portions of a charge high voltage generation circuit and a frequency switching circuit according to a second embodiment of the present invention.

FIG. 7 is a circuit diagram showing a portion of the charge high voltage generation circuit and frequency switching circuit in the second embodiment. In FIG. 7, the same or corresponding portions as those in the first embodiment are designated by the same reference numerals and their overlapped descriptions are omitted.

A circuit construction to switch the frequency of the charge AC bias by the switching signal from the controller 1 as a feature of the second embodiment and its operation will now be described with reference to FIG. 7.

In FIG. 7, IC301 denotes a frequency divider. The output of the first rectangular wave oscillator for determining the developing frequency is connected to an input terminal IN. Signals of frequencies of 1/6, 1/5, and $\frac{1}{4}$ of the frequency of the input signal are generated from output terminals a, b, and c, respectively. Transistors Q301 to Q303 and resistors R301 to R306 construct a frequency switching circuit. Signal lines HVIF1, HVIF2, and HVIF3 connected to the frequency switching circuit are also connected to the controller 1. An operational amplifier IC302 executes the level conversion of the signal of the frequency switching circuit. The remaining construction is similar to that of the first embodiment.

In FIG. 7, one of the transistors Q301 to Q303 is turned off by either one of the signals HVIF1 to HVIF3 which is interlocked with the switching of the print density of the controller 1 and the other two transistors are turned on. Therefore, for example, in the case where the transistor Q301 is turned off and the transistors Q302 and Q303 are turned on, the frequency of 1/6 which is derived by the frequency divider IC301 is selected and supplied to the operational amplifier IC302. Thus, the frequency of the charge alternating current is synchronized with that of the development alternating current and is set to the frequency of 1/6 of the frequency of the development alternating current. Similarly, a frequency of 1/5 or $\frac{1}{4}$ can be selected by a signal from the controller 1 at the time of the change of the print density. For instance, in the case of a laser beam printer, a rotating frequency of a polygon mirror and a pixel clock for modulating a laser beam are changed interlockingly with the print density switching signals HVIF1 to HVIF3, so that a desired print density is obtained.

Now, assuming that the frequency of the development alternating current is set to 1850 Hz, the charge AC frequency is set to 370 Hz of $\frac{1}{4}$ of the development AC frequency in the case of a resolution of 600 dpi, 308 Hz of 1/5 in the case of 480 dpi, and 264 Hz of 1/6 in the case of 400 dpi or less as shown in FIG. 6. Thus, even when the print density is switched, no moire occurs and the generation of the charging noises can be minimized.

As described above, by setting the frequency of the developing bias to a value which is integer times as high as the frequency of the charging bias and by synchronizing those two frequencies, the image forming apparatus can eliminate the influence on the image by the interference of the frequencies of the development bias alternating current and the charge bias alternating current. On the other hand, a frequency dividing ratio for determining the charge bias frequency from the development bias frequency is switched in correspondence to the print density, so that the occurrence of a moire in the image or the generation of charging noises in the case where the print density was switched can be eliminated.

(EMBODIMENT 3)

Figure 8:
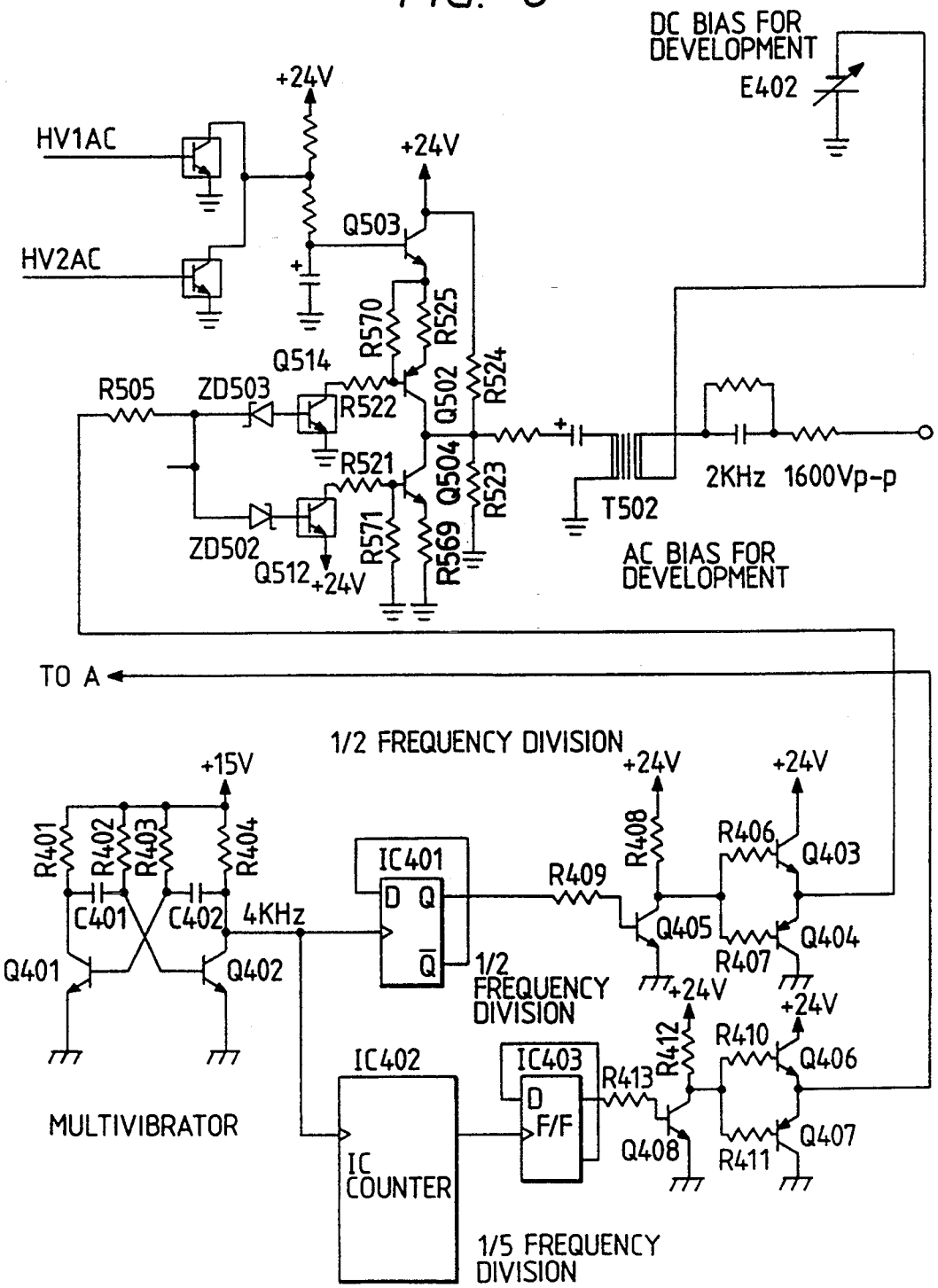
FIG. 8 is a circuit diagram of a main section according to a third embodiment of the present invention.
Figure 9:
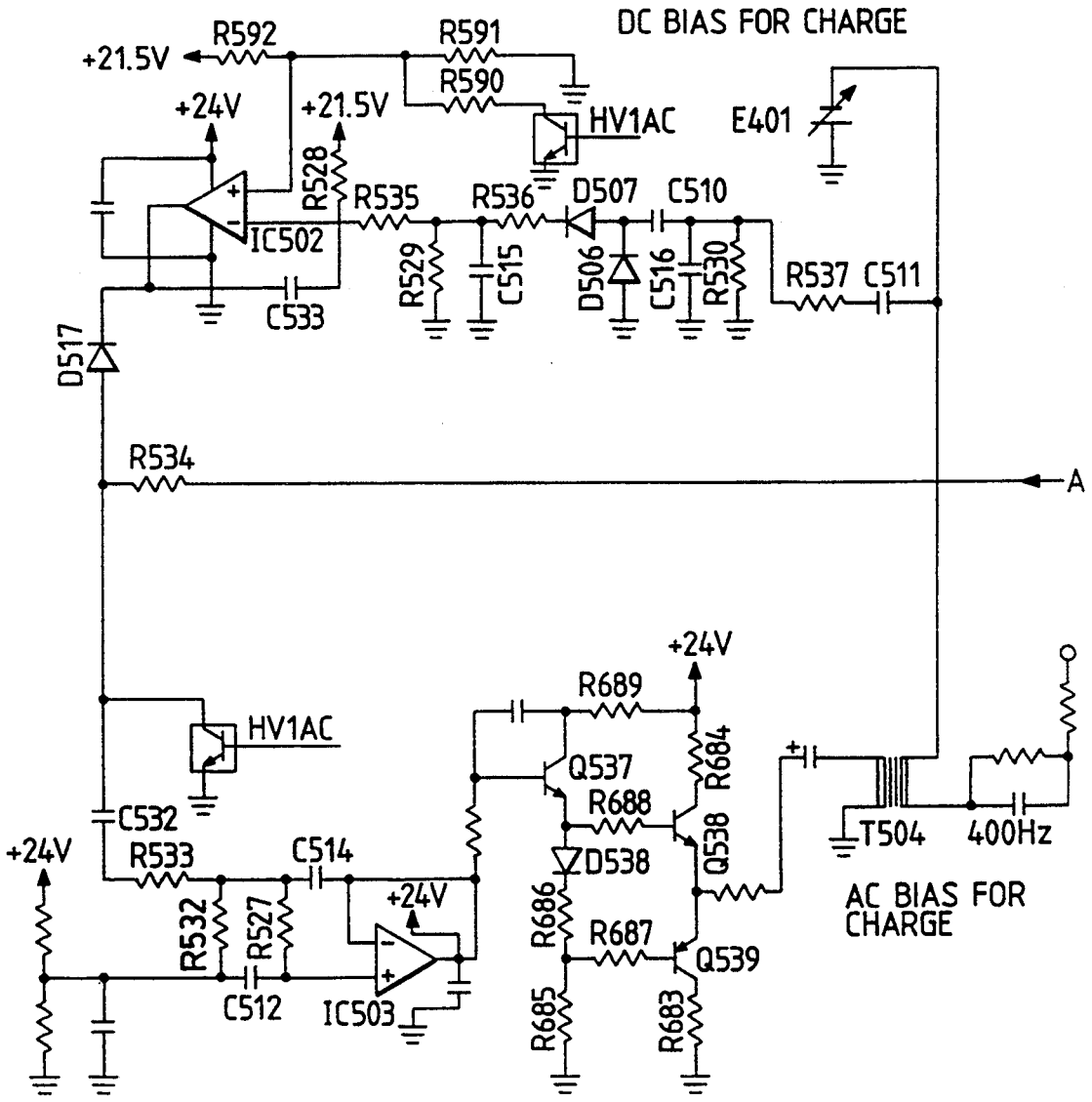
FIG. 9 is another circuit diagram of a main section in the third embodiment.

FIGS. 8 and 9 are circuit diagrams of a main section of "an image forming apparatus" according to a third embodiment. Although the circuit diagram of the image forming apparatus is divided into two diagrams, it will be understood that FIGS. 8 and 9 are coupled by lines shown by arrows.

In FIG. 8, T502 denotes a transformer for generating an AC bias for development. The transistors Q502 to Q504, Q512, and Q514, Zener diodes ZD502 and ZD503, and resistors R521 to R525, R569, R570, and R571 construct a driver of the transformer T502. E402 denotes a power source for generating a DC bias for development.

In FIG. 9, T504 denotes a transformer for generating an AC bias for charging. The transistors Q537 to Q539, resistors R683 to R689, and diode D538 construct a driver of the transformer T504.

The operational amplifier IC503, resistors R527, R532, and R533, and capacitors C512, C514, and C532 construct an active filter. An output of the active filter is supplied to the driver of the transformer T504.

R530 denotes an AC current detecting resistor for detecting an AC current flowing in a charging roll as a load through the capacitor C511 and resistor R537. The capacitor C516 is provided to eliminate noises of high frequencies.

The capacitors C515 and C510, diodes D506 and D507, and resistors R528, R529, and R535 construct a rectifying circuit for voltage doubler rectifying the voltage which is generated in the AC current detecting resistor R530.

The operational amplifier IC502 compares the potential which is obtained by dividing the voltage by the resistors R590 to R592 and the output of the above rectifying circuit. The operational amplifier IC502 controls through the diode D517 the amplitude of the rectangular wave which is supplied through a resistor R534 from a generation circuit of a rectangular wave signal, which will be explained below, thereby constant current controlling the alternating current flowing in the load. E401 denotes the power source to generate the DC bias for charging.

A generation circuit of a rectangular wave signal to decide the frequencies of the AC bias for development and the AC bias for charging will now be described. In FIG. 8, transistors Q401 and Q402, resistors R401 to R404, and capacitors C401 and C402 construct an oscillator by a self-running multivibrator. An output of the oscillator is frequency divided into ½ by a D flip-flop IC401 of a CMOS IC and is set to a rectangular wave signal for the AC bias for development. The output of the IC401 is sent through a driver comprising transistors Q403 to Q405 and resistors R406 and R409 and is supplied through a resistor R505 to the driver of the transformer T502 for generating the AC bias for development.

The output of the oscillator is branched and is frequency divided into 1/n by a counter IC402 of the CMOS IC. An output of the counter IC402 is further frequency divided into ½ by a D flip-flop IC403 of the CMOS IC. An output of the D flip-flop IC403 is sent through the driver comprising transistors Q406 to Q408 and resistors R410 to R413 and is supplied through the resistor R534 (refer to FIG. 9) to the filter of the AC bias for charging comprising the operational amplifier IC503.

The operation of the circuit will now be described. An oscillating frequency of the multivibrator comprising the transistors Q401 and Q402 is set to 4 kHz. An output of the multivibrator is frequency divided into ½ by the D flip-flop IC401 and obtains a signal of 2 kHz. This signal is amplified by the driver of the transformer T502 and stepped up by the transformer T502, thereby generating a voltage of about 1600 $V_{pp}$. This voltage is multiplexed with the DC voltage of the power source E402 and the resultant voltage is used as a development bias.

Although a duty of the oscillating waveform of the multivibrator is not equal to 50%, since its output signal passes through the ½ frequency divider of the D flip-flop IC401, the duty is set to 50%. When the duty is not equal to 50%, a state in which a DC voltage is generated in addition to the AC voltage occurs, resulting in a direct current being multiplexed with the DC voltage of the power source E402. An unexpected bias is applied. Consequently, a toner potential of the developing unit fluctuates, such that an overlap toner undesirably is deposited onto the photosensitive drum, and the image becomes thin.

The output of the multivibrator is branched and frequency divided by the counter IC402. In the present embodiment, a frequency dividing ratio is set to 1/5. An output of the counter IC402 is further frequency divided into ½ by the D flip-flop IC403, thereby obtaining a rectangular wave of 400 Hz having a duty ratio of 50%. The rectangular wave is rectified as a sine wave by the active filter comprising the operational amplifier IC503 and is supplied to the driver of the transformer T504 and is stepped up by the transformer T504. The step-up voltage is multiplexed with the DC voltage of the power source E401 and the resultant signal is supplied to the charging unit.

As will be understood from the above description, since the AC bias for charging is synchronized with the AC bias for development, a fringe of the image due to interference doesn't occur. A frequency of the AC bias for charging can be arbitrarily set, and the moire on the image occurring due to the relation with the print density can be eliminated.

(EMBODIMENT 4)

Figure 10:
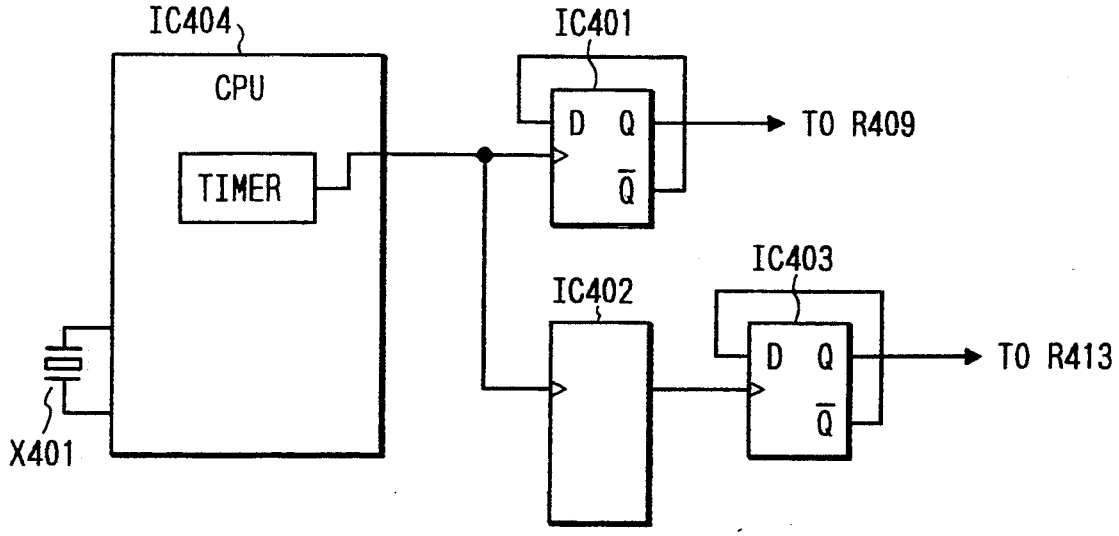
FIG. 10 is a block diagram of a main section according to a fourth embodiment of the present invention.

The fourth embodiment relates to an example in which a CPU is used in the generation circuit of the rectangular wave signal. FIG. 10 shows a generation circuit of the rectangular wave signal in the present embodiment. Since a circuit construction of the present high voltage generation circuit is similar to that in the third embodiment, a description of it is omitted. In FIG. 10, IC404 denotes a one-chip microprocessor having therein a ROM, a RAM, an I/O port, a timer, and the like. For example, an IC such as μPD7811 made by NEC Corporation can be used.

The CPU IC404 has a very stable oscillator using a quartz oscillator X401. The CPU IC404 further has a high stable timer using clocks which are generated from the oscillator. When a rectangular wave of a frequency of 4 kHz is generated by the timer, a rectangular wave signal of a stable frequency can be obtained by the foregoing multivibrator. A set value of the timer can be easily changed in accordance with the print density of the image forming apparatus so as to avoid a frequency at which a moire occurs in FIG. 6.

An output signal of the CPU IC404 is frequency divided into ½ by the D flip-flop IC401 and is generated as a high voltage alternating current for a development bias from the transformer T502 (refer to FIG. 8). The output signal of the CPU IC404 is, on the other hand, frequency divided by the counter IC402 and is further frequency divided by the D flip-flop IC403 and is sent to the driver of the transformer T504 and is generated as a high voltage alternating current for charging (refer to FIG. 9).

(EMBODIMENT 5)

Figure 11:
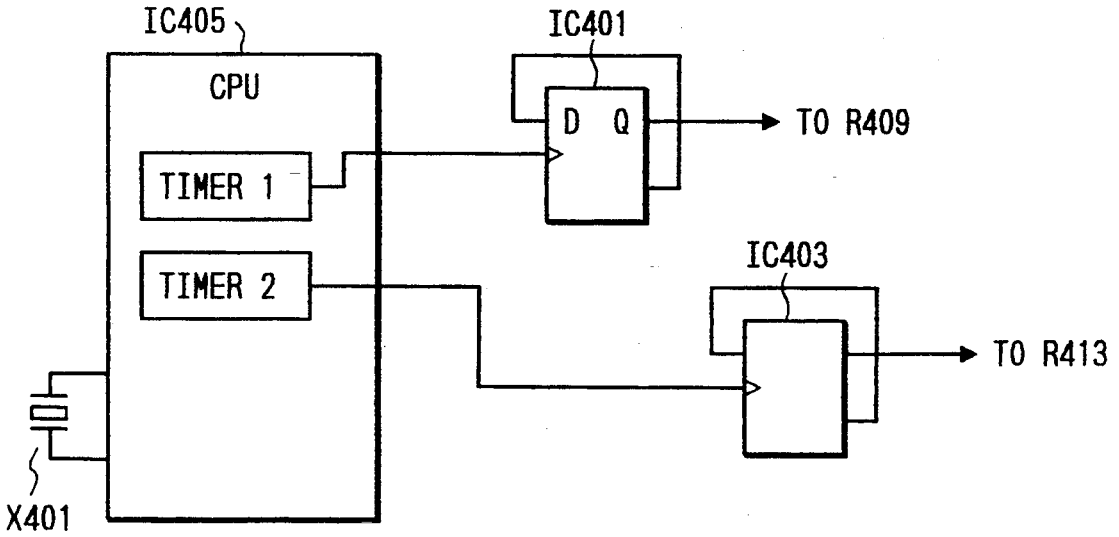
FIG. 11 is a block diagram of a main section according to a fifth embodiment of the present invention.

FIG. 11 shows a generation circuit of a rectangular wave signal in the fifth embodiment. Since a circuit construction of a high voltage generation circuit is similar to that in the third embodiment, its description is omitted. In FIG. 11, IC405 denotes a CPU having a plurality of timers. Timer 1 generates a pulse signal of 4 kHz. Timer 2 generates a pulse signal of 800 Hz.

Timers 1 and 2 use an oscillation output of the same quartz oscillator X401, so that the respective phases of the output pulses of timers 1 and 2 are synchronized with each other. Those outputs are frequency divided into ½ by the D flip-flops IC401 and IC403 and used as rectangular waves of 2 kHz and 400 Hz, respectively.

By using the above construction, an effect similar to that in the fourth embodiment can be obtained in addition to the effect of the third embodiment.

As described above, by setting the frequency of the AC bias for development to a value which is integer times as high as the frequency of the AC bias for charging, and synchronizing those two frequencies, the influence on an image formed by interference between those frequencies can be eliminated. Since the frequency dividing ratio for determining the frequency of the AC bias for charging is varied in accordance with the print density, any influence on the image in the case where the print density has varied in the same apparatus can be reduced.

Further, since the ½ frequency divider is used for each of the AC bias for development and the AC bias for charging, a voltage alternate current of a duty of 50% can be obtained and the unexpected deterioration of the picture quality can be avoided.

The present invention is not limited to the foregoing embodiments but many modifications and variations are possible within the spirit and scope of the appended claims of the invention.

What is claimed is:

1. An image forming apparatus comprising:

a photosensitive member;

a charging member for charging said photosensitive member;

a developing member for developing a visible image from an electrostatic latent image formed on the photosensitive member;

first supply means for supplying an output which is obtained by multiplexing a first AC voltage with a first DC voltage to said changing member; and second supply means for supplying an output which is obtained by multiplexing a second AC voltage with a second DC voltage to said developing member, wherein a ratio of frequencies of said first and second AC voltages is set to an integer.

2. An apparatus according to claim 1, further having a sync circuit for synchronizing said first and second AC voltages.

3. An apparatus according to claim 2, wherein said sync circuit has a frequency signal generating section and a frequency dividing circuit for frequency dividing a frequency signal from said frequency signal generating section, thereby producing said first and second AC voltages.

4. An apparatus according to claim 1, wherein said charging member is brought into contact with said photosensitive member and charges the photosensitive member.

5. An apparatus according to claim 1, further having changing means for changing said frequency ratio in accordance with a print density.

6. An apparatus according to claim 1, wherein said image forming apparatus is a laser beam printer for recording on said photosensitive member using a laser beam.

7. A high voltage power source device of an image forming apparatus, comprising:

a charge high voltage generation circuit for supplying an output which is obtained by multiplexing a high AC voltage with a high DC voltage to a charging member which is brought into contact with a photosensitive member of image forming apparatus and charges said photosensitive member;

a development high voltage generation circuit for supplying an output which is obtained by multiplexing a high AC voltage with a high DC voltage to a developing member for developing a visible image from an electrostatic latent image formed on said photosensitive member; and a sync circuit for synchronizing a high voltage alternating current of said charge high voltage generation circuit with a high voltage alternating current of said development high voltage generation circuit, wherein a frequency of a high voltage alternating current of the development high voltage generation circuit is integer times as high as a frequency of a high voltage alternating current of the charge high voltage generation circuit.

8. A high voltage power source device of an image forming apparatus, comprising:

a charge high voltage generation circuit for supplying an output which is obtained by multiplexing a high AC voltage with a high DC voltage to a charging member which is brought into contact with a photosensitive member of said image forming apparatus and charges said photosensitive member;

a development high voltage generation circuit for supplying an output which is obtained by multiplexing a high AC voltage with a high DC voltage to a developing member for developing a visible image from an electrostatic latent image formed on said photosensitive member;

an oscillator for determining a frequency of a high voltage alternating current of said development high voltage generation circuit; and a frequency divider for frequency dividing an output of said oscillator, wherein a frequency of a high voltage alternating current of the development high voltage generation circuit is determined by an output of said frequency divider and a frequency dividing ratio of the frequency divider is varied in accordance with variations in print density.

9. An electrophotographic image forming apparatus, comprising:

a charging member which is brought into contact with a photosensitive member and charges said photosensitive member;

a first high voltage power source for supplying an output which is obtained by multiplexing a high AC voltage with a high DC voltage to said charging member;

a developing member for developing a visible image from an electrostatic latent image formed on said photosensitive member; and a second high voltage power source for supply an output which is obtained by multiplexing a high AC voltage with a high DC voltage to said developing member, wherein the high AC voltages of said first and second high voltage power sources are respectively produced from signals which are obtained by frequency dividing a single clock signal and in which a ratio of frequencies after completion of the frequency division is equal to an integer.

10. An apparatus according to claim 9, wherein each of said signals is derived through a $\frac{1}{2}$ frequency divider.

* * * * *

UNITED STATES PATENT AND TRADEMARK OFFICE

CERTIFICATE OF CORRECTION

PATENT NO. : 5,365,316

DATED : November 15, 1994

INVENTOR(S) : Motoyama et al.

It is certified that error appears in the above-indentified patent and that said Letters Patent is hereby corrected as shown below:

Cover Page

[56] References Cited
"Nakabara et al." should read
--Nakahara et al.--

Column 1

Line 26, "come" should read --brought--.

Column 2

Line 6, "development" should read --development,--.

Column 6,

Line 15, "few as 2 kHz." should read --few kHz, such as 2 kHz.--.

UNITED STATES PATENT AND TRADEMARK OFFICE

CERTIFICATE OF CORRECTION

PATENT NO. : 5,365,316 Page 2 of 2

DATED : November 15, 1995

INVENTOR(S) : Motoyama et al.

It is certified that error appears in the above-indentified patent and that said Letters Patent is hereby corrected as shown below:

Column 11

Line 8, "changing" should read --charging--;
Line 41, "of" should read --of said--.

Column 12

Line 42, "supply" should read --supplying--.

Signed and Sealed this

Second Day of May, 1995

*Attest:*

*Attesting Officer*

BRUCE LEHMAN

*Commissioner of Patents and Trademarks*